US006579145B1

(12) United States Patent
Maxim

(10) Patent No.: US 6,579,145 B1
(45) **Date of Patent: *Jun. 17, 2003**

(54) TOY COMPRISING INTERCONNECTED FIGURES HAVING DIRECTIONALLY SELECTABLE SPRING-LOADED PROPULSION MECHANISMS

(76) Inventor: John G. Maxim, 863 Coventry St., Boca Raton, FL (US) 33487-3106

( * ) Notice: Subject to any disclaimer, the term of this patent is extended or adjusted under 35 U.S.C. 154(b) by 0 days.

This patent is subject to a terminal disclaimer.

(21) Appl. No.: 09/353,292

(22) Filed: Jul. 12, 1999

Related U.S. Application Data

(63) Continuation-in-part of application No. 08/928,108, filed on Sep. 12, 1997, now Pat. No. 5,964,639.

(51) Int. Cl.[7] ..... A63H 33/00; A63H 17/00

(52) U.S. Cl. ..... 446/437; 446/4; 473/595

(58) Field of Search ..... 446/4, 6, 310, 446/312, 409, 427, 430, 431, 437, 458, 459, 462, 486; 473/571, 595; 434/300, 302

(56) References Cited

U.S. PATENT DOCUMENTS

| | | | | |
|---|---|---|---|---|
| 2,078,382 A | | 4/1937 | Hanshaw | |
| 2,627,700 A | | 2/1953 | Weiss | |
| 3,106,397 A | | 10/1963 | Lacey | |
| 4,466,214 A | | 8/1984 | Kulesza et al. | |
| 4,925,428 A | | 5/1990 | Sonesson | |
| 5,297,981 A | | 3/1994 | Maxim et al. | |
| 5,380,231 A | * | 1/1995 | Brovelli | 446/6 |
| 5,618,219 A | | 4/1997 | Simone et al. | |
| 6,086,449 A | * | 7/2000 | Sharp | 446/486 |

* cited by examiner

*Primary Examiner*—Derris H. Banks
*Assistant Examiner*—Dmitry Suhol
(74) *Attorney, Agent, or Firm*—Oltman, Flynn & Kubler

(57) ABSTRACT

A toy for entertaining a user includes a composite structure configured to execute a play function, the composite structure including several removably interconnected structure elements, each said structure element having at least one propulsion mechanism including a spring-loaded, directionally selectable propulsion member connected to the structure element. The triggering object is optionally a play surface and the element shell optionally includes a representation of a human or animal face. The composite structure has at least two of the structure elements, each structure element having a propulsion mechanism so that several propulsion mechanisms are distributed over the outer extremities of the composite structure for depressing and tilting by the user in individually selected directions into engagement with the shoulder engaging structure.

11 Claims, 2 Drawing Sheets

TOY COMPRISING INTERCONNECTED FIGURES HAVING DIRECTIONALLY SELECTABLE SPRING-LOADED PROPULSION MECHANISMS

FILING HISTORY

This application is a continuation-in-part of application Ser. No. 08/928,108, now U.S. Pat. No. 5,964,639 filed on Sep. 12, 1997.

BACKGROUND OF THE INVENTION

1. Field of the Invention

The present invention relates generally to the field of toys animated by energy-storing mechanisms. More specifically the present invention relates to a toy including several separably interconnected figure elements defining a composite structure, each figure element including a spring-loaded, directionally selectable propulsion mechanism. The figure element includes a element shell including a shell interconnection portion having a shell interconnection structure and a shell propulsion portion having the propulsion mechanism.

Each propulsion mechanism includes a coil spring secured at a spring base end to the element shell and secured at a spring free end to a projection member. The projection member has an outwardly extending contact end and an inwardly directed stop end and has a circumferential shoulder between the contact end and the stop end. The projection member protrudes between opposing and spaced apart shoulder engaging structures in the shell propulsion portion, so that pressing the projection member toward the element shell against the biasing of the spring and then tilting the projection member laterally to a certain angle causes the shoulder to move underneath a shoulder engaging structure, and so that reducing pressure against the projection member and spring causes the shoulder to move against and into engaging contact with the shoulder engaging structure. As a result of this construction, an impact of the projection member with another object such as the floor, another toy or an element of the same toy, dislodges the shoulder from the shoulder engaging structure, freeing the projection member to accelerate outwardly under the power of the coil spring at substantially the selected angle of projection member tilt. The outwardly accelerating projection member rapidly bears against the triggering object and causes an entertaining movement of the toy.

The element shell may take any of several forms. The contact end is preferably fitted with a resilient ball defining the head of a figure. The interconnection portion preferably includes a spherical cover which may be painted or otherwise with the impression of a face, so that the figure elements appear to be interconnected characters. The figure element may have the appearance of a person or animal figure. Fabric wings may be attached to and extend laterally from the ball head of the figure to render the appearance of wings flopping during bounce. Accessories such as pneumatic reed sound devices can also be attached (or designed to be internally housed) to create sounds when the composite structure is bounced.

The composite structure optionally includes six interconnected figure elements joined together in such a way that their six above-described propulsion mechanisms are equally spaced and uniformly distributed, the directly opposing figure elements each defining one of three mutually perpendicular and intersecting axes. Varying numbers of structure elements may be interconnected in different ways to produce a variety of composite structure configurations.

2. Description of the Prior Art

There have long been toys propelled by energy stored in internal springs and there have been toy balls constructed with means for random and unpredictable bouncing movements.

Hanshaw, U.S. Pat. No. 2,078,382, issued on Apr. 27, 1937, discloses a playing ball made of a resilient material such as rubber. Intersecting bands or spaced apart bumps made of the same resilient material protrude from the ball spherical surface and cause the ball to bounce at unpredictable angles upon impacting a play surface. The bands or bumps are spaced apart sufficiently that the even ball spherical surface occasionally and randomly strikes the play surface to rebound at a conventional angle approximating the angle of approach. A problem with Hanshaw is that the ball has no stored energy beyond that imparted to it from the force of a throw and from gravity, so that rebound velocity diminishes rapidly. Another problem is that the user has no control over rebound angles, limiting user involvement, variations in ball use and user interest.

Kulesza, et al., U.S. Pat. No. 4,466,214, issued on Aug. 21, 1984, teaches an impact-responsive toy vehicle. Kulesza, et al. includes a conventional toy vehicle with a vehicle body and vehicle wheels, with a spring-biased foot portion mounted underneath the vehicle floor and a foot portion triggering mechanism. The triggering mechanism includes a generally rectangular latching member which is mounted to slide parallel to the vehicle floor, the forward end of the latching member forming the vehicle front bumper and a rearward section fitting underneath the foot portion. When the toy vehicle is propelled forwardly on its wheels and strikes an obstacle, the impact depresses the front bumper, sliding the latching member rearwardly relative to the foot portion. The displacement of the latching member frees the foot portion to pivot with the force of the biasing spring and rapidly accelerate against the vehicle support surface, flipping the vehicle over to simulate a spectacular crash. Problems with Kulesza, et al. are that the user has no control over foot propulsion direction, and only one propulsion mechanism is provided so that a sequence of bouncing actions is not produced.

Simone, et al., U.S. Pat. No. 5,618,219, issued on Apr. 8, 1997, reveals a remote control toy vehicle with a powered jumper mechanism similar to that of Kulesza, et al. The only fundamental differences are that the foot member is cam-shaped rather than planar and is actuated by an electric motor rather than by spring release.

Weiss, U.S. Pat. No. 2,627,700, issued on Feb. 10, 1953, discloses a jumping puppet apparatus. The apparatus includes a miniature model human torso and a flexible skirt portion extending downwardly from the torso to puppet-supporting, interconnected puppet feet. A coil spring is mounted within a longitudinal tube extending into the base of the torso, and a radial flange extends inwardly from the perimeter of the downwardly directed tube opening. The spring bears against a piston, and a drive rod having a rod shoulder interconnects the piston and the puppet feet. To cock the jumping mechanism, the user presses the puppet feet toward the torso against the biasing of the coil spring until the rod shoulder passes the radial flange. Then the rod is slightly pivoted laterally and pressure against the spring is eased to cause the rod shoulder to bear against the radial flange. Dropping the upright puppet vertically causes the feet to strike a play surface, jar the rod and dislodge the shoulder from the radial flange. The coil spring then propels the drive rod and puppet feet downwardly against the play surface and causes the puppet to jump. A problem with Weiss is that the lateral positioning of the drive rod to cause the shoulder to engage the radial flange is very slight, and does not materially alter or control the puppet jumping direction. Another problem is that only one propulsion mechanism is provided, and thus no entertaining sequence of jumps is disclosed. Still another problem is that the spring does not overlap or enter the piston, so that the propulsion mechanism bore must be quite deep.

Maxim, et al., U.S. Pat. No. 5,297,981, issued on Mar. 29, 1994, teaches a self-propelled bouncing ball. This ball includes an outer spherical shell containing a motorized center of gravity shifting mechanism, rotating an internal weight around a diametric internal mounting shaft. While this ball produces a random and generally unpredictable bouncing motion, the cost of its manufacture with the internal mechanism limits the product to a relatively high-end market. The rotating weight also provides for no user pre-selection of bounce directions.

Sonesson, U.S. Pat. No. 4,925,428, issued on May 15, 1990, reveals a ball with an unbalance mechanism. Sonesson includes a ball having a diametric internal bore lined with a guide tube containing a sliding piston weight. The weight includes a spring-powered mechanism which slides the piston weight from one end of the guide tube to the other end as the ball rolls, shifting the ball center of gravity and producing an irregular rolling pattern. A problem with Sonesson is that the user cannot select and pre-set rolling directions. Another problem is that the shifting of the center of gravity does not release stored ball propelling energy to the ball as it moves, limiting the play time for each roll. Still another problem is that no entertaining jumping action is produced.

Lacey, U.S. Pat. No. 3,106,397, issued on Oct. 8, 1963, discloses a ball toy having spring-loaded propulsion mechanisms projecting from discrete points over the ball exterior surface. The ball is essentially a solid spherical body and each propulsion mechanism includes a radial bore in the body containing a coil spring. Each bore has a circumferential internal latching groove. A hollow cylindrical piston with a laterally extending latching structure is slidably fitted into each bore against the biasing of the coil spring. The latching structure is connected to a triggering pin protruding outwardly through the piston, and engages the latching groove. When the ball is dropped and one of the propulsion mechanism pins strikes the ground, the impact dislodges the latching structure from the groove and thereby releases the piston to slide within the bore. The coil spring drives the piston rapidly outward to strike the ground and propel the ball away from the ground, so that upon landing again, another propulsion mechanism pin may be struck, producing a series of bounces or jumps. A problem with Lacey is that the user cannot select and pre-set the directions of ball propulsion.

It is thus an object of the present invention to provide a toy with several propulsion mechanisms, each of which stores energy independently for sequential propulsion of the toy or a part of the toy.

It is another object of the present invention to provide such a toy which is a composite structure made up of several removably interconnected elements which may be configured as people, animals or various inanimate, each element having its own separate propulsion mechanism and being separable from the composite structure for independent use.

It is still another object of the present invention to provide such a toy in which each propulsion mechanism propels the toy in a selected and approximately pre-set individual direction, does not require a deep bore or recess and is compact.

It is yet another object of the present invention to provide such a toy which prolongs bouncing action by releasing energy which is stored prior to bouncing sequence initiation.

It is finally an object of the present invention to provide such a toy which is economical to manufacture, simple, sturdy and genuinely intriguing for children and adults alike.

SUMMARY OF THE INVENTION

The present invention accomplishes the above-stated objectives, as well as others, as may be determined by a fair reading and interpretation of the entire specification.

A toy is provided for entertaining a user, including a composite structure configured to execute a play function, the composite structure including several removably interconnected structure elements, each said structure element having at least one propulsion mechanism including a spring-loaded, directionally selectable propulsion member connected to the structure element.

The structure elements preferably each include an element shell, and the at least one propulsion mechanism preferably includes one of the projection members, a coil spring having a compressed mode and a relaxed mode and having a spring base end and a spring free end, the spring base end being connected to the element shell and the spring free end being connected to the projection member, a structure for retaining the spring in a compressed mode and angled to a selected direction, and a structure for releasing the spring from the compressed mode upon impact of the projection member with a triggering object to propel the element shell together with the entire composite structure and the triggering object apart from each other. The at least one projection member preferably includes an outwardly extending contact end and an inwardly directed stop end, where the structure for retaining the spring and the structure for releasing the spring include a circumferential shoulder between the contact end and the stop end, and where the projection member protrudes outwardly from the element shell between opposing and spaced apart shoulder engaging structure portions, so that pressing the projection member toward the element shell against the biasing of the spring and then tilting the projection member laterally to a certain angle in the selected direction causes the shoulder to move underneath one of the shoulder engaging structure portions, and so that subsequently reducing pressing force against the projection member causes the shoulder to move against and into engaging contact with the shoulder engaging structure portion, and so that impact of the projection member with the triggering object dislodges the shoulder from the shoulder engaging structure portion, thereby freeing the projection member to accelerate outwardly with the force of the coil spring against the triggering object.

It is preferred that the projection member is a projection cup member having a substantially circular cup end wall and a tubular cup side wall, and that the shoulder is circumferential along the cup side wall, and that the spring base end is anchored within a recess in the element shell, and the spring is longer in the relaxed mode than the projection cup member and extends into the cup member, the spring free end being connected to the cup end wall, and that the shoulder engagement structure includes a lip protruding radially inwardly around the outer end of the recess.

The recess preferably includes a recess cup member fitted into a recess receiving port in the element shell and having a circular recess bottom wall and a tubular recess side wall and includes an outwardly bent shell engaging rim which engages the edge of the recess receiving port.

The triggering object is optionally a play surface and the element shell optionally includes a representation of a human or animal face. The composite structure has at least two of the structure elements, each structure element having a propulsion mechanism so that several propulsion mechanisms are distributed over the outer extremities of the composite structure for depressing and tilting by the user in individually selected directions into engagement with the shoulder engaging structure, so that projecting the composite structure against the play surface causes at least one of the projection members to contact the play surface and release the at least one projection member from engagement with its shoulder engaging structure, and so that the at least one projection member springs outwardly and delivers a propulsion member force against the play surface in a direction corresponding to the direction in which the projection member was tilted and the force combines with and alters the existing directional momentum of the composite structure.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
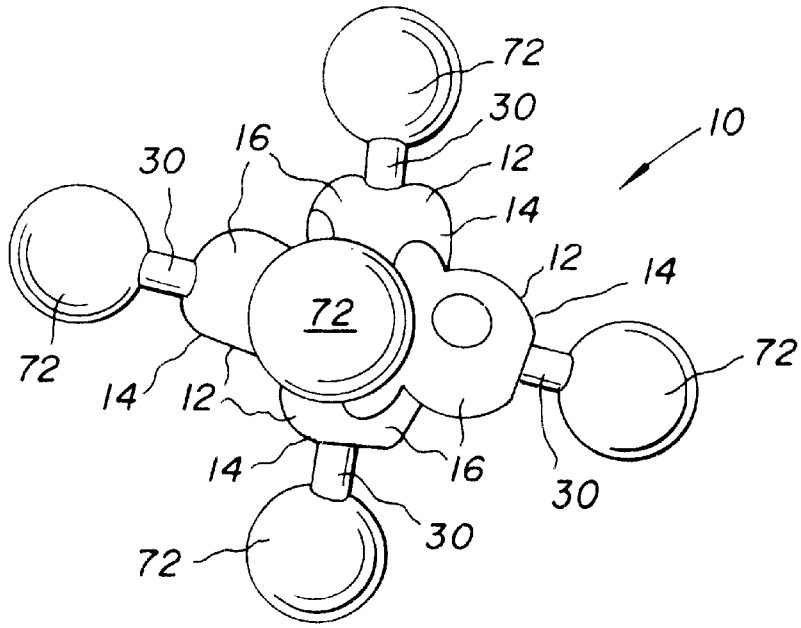
FIG. 1 is a perspective view of the preferred embodiment of the present invention with several structural elements interconnected to form a composite structure, where the projection members are released and at full extension.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

PREFERRED EMBODIMENTS

Figure 2:
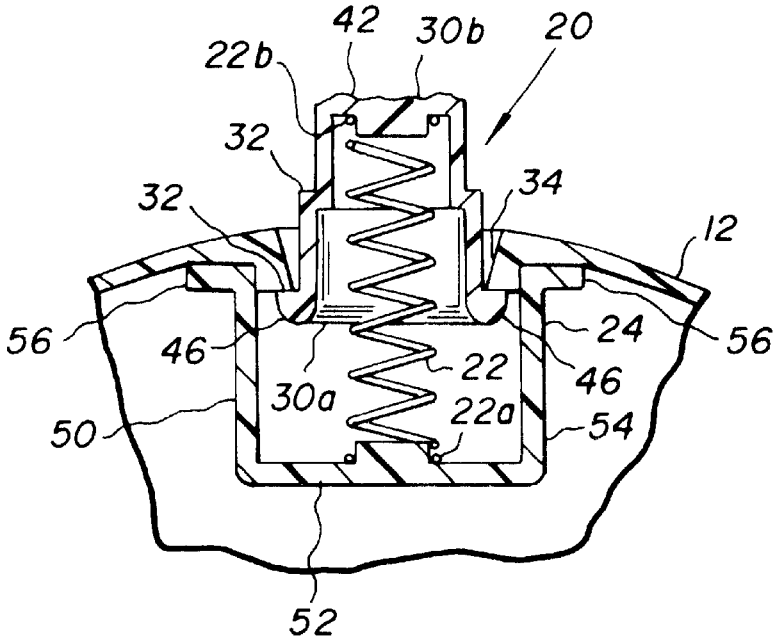
FIG. 2 is a cross-sectional side view of a separated structure element in the form of a human figure.
Figure 3:
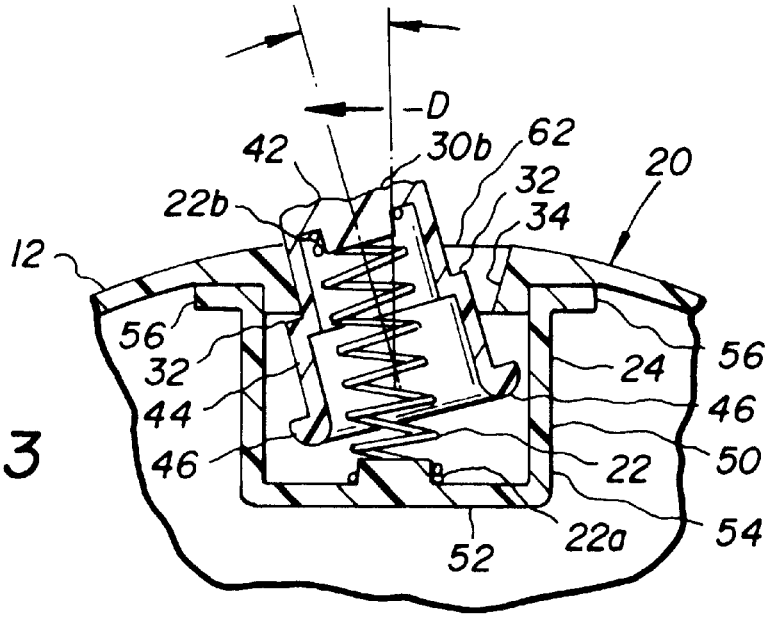
FIG. 3 is a cross-sectional side view of a propulsion mechanism with the projection member cup released and at full extension.
Figure 4:
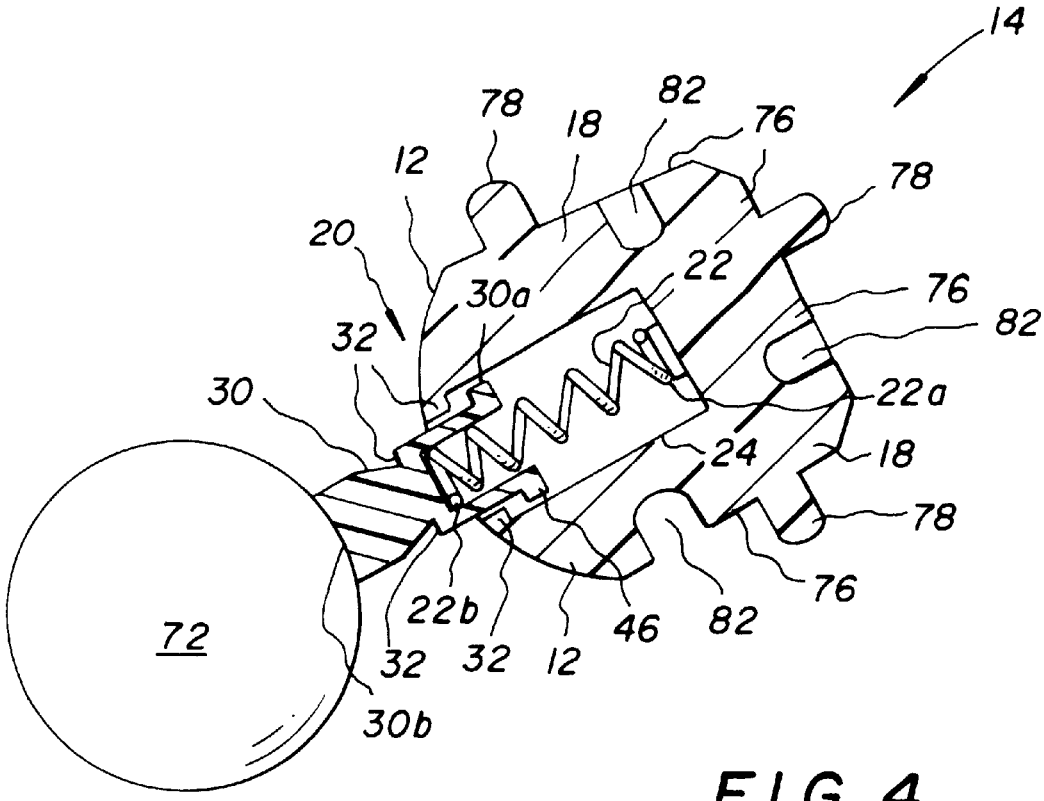
FIG. 4 is a view as in FIG. 2, but showing the projection member cup depressed and tilted with the shoulder engaged by the shoulder engaging structure.

Referring to FIGS. 1–4, a toy 10 is disclosed including several separably interconnected structure elements 14 defining a composite structure 16, each structure element 14 including a spring-loaded, directionally selectable propulsion mechanism 20. The structure element 14 includes a element shell 12 including a shell interconnection portion having a shell interconnection structure 18 and a shell propulsion portion having the propulsion mechanism 20.

Each propulsion mechanism 20 includes a coil spring 22 secured at a spring base end 22*a* to the element shell 12 and at a spring free end 22*b* to a projection member 30. The projection member 30 has an outwardly extending contact end 30*b* and an inwardly directed stop end 30*a* and has a circumferential shoulder 32 between the contact end 30*b* and the stop end 30*a*. The contact end is preferably fitted with a resilient ball. The projection member 30 protrudes between opposing and spaced apart shoulder engaging structures 34 in the shell propulsion mechanism 20, so that pressing the projection member 30 toward the element shell 12 against the biasing of the spring 22 and then tilting the projection member 30 laterally to a certain angle causes the shoulder 32 to move underneath a shoulder engaging structure 34, and so that reducing pressure against the projection member 30 and spring 22 causes the shoulder 32 to move against and into engaging contact with the shoulder engaging structure 34. As a result of this construction, an impact of the projection member 30 with another object such as the floor 40, another toy 10 or an element of the same toy 10, dislodges the shoulder 32 from the shoulder engaging structure 34, freeing the projection member 30 to accelerate outwardly under the power of the coil spring 22 at substantially the selected angle of projection member 30 tilt. The outwardly accelerating projection member 30 rapidly bears against the triggering object 40 and causes an entertaining and enhanced bounce of the toy 10. Sequential striking of depressed and engaged projection members 30 releases members 30 to create a sequence of enhanced bounces.

Each projection member 30 is preferably a cup or bore having a circular contact end wall 42 and a tubular cup side wall 44, the shoulder 32 being a circumferential diameter changing step midway along the side wall 44. Spring 22 preferably has a spring base end 22*a* mounted within a shell retaining portion 24 recess in element shell 12 with a first bent-over tab or clip. Spring 22, which is longer at rest than projection member 30, preferably extends into the projection member 30 cup and spring outward end 30*b* is secured to cup end wall 42 with a second bent-over tab or clip. The stop end 30*a* of the projection member 30 cup is a cup rim 46 which abuts the shell retaining portion 24 recess and thereby acts as a stop when the projection member 30 is depressed sufficiently to permit shoulder 32 engagement with an engaging structure 34 and acts as a stop against the shoulder engaging structure when the projection member 30 reaches full extension. The shoulder engaging structure 34 is preferably a recess lip or ridge protruding radially inward around the shell retaining portion 24 recess outer end. The recess itself is preferably a recess cup member 50 having a circular recess bottom wall 52 and a tubular recess side wall 54 and having an outwardly bent recess engaging rim 56 which engages the element shell 12 around the perimeter of a projection member port 62.

The element shell 12 may take any of several forms. The interconnection portion 18 preferably includes a spherical cushion or cover 72 which may be painted or otherwise marked with the impression of a face, so that structure elements 14 appear to be interconnected human or animal characters. Composite structure 16 preferably includes six interconnected structure elements 14 joined together in such a way that their six above-described propulsion mechanisms 20 are equally spaced and uniformly distributed, the directly opposing structure elements each defining one of three mutually perpendicular and intersecting axes.

The interconnection structure includes a connection surface 76 having multiple sides or being curved, and having several connecting studs 78 and several stud receiving recesses 82 which snugly and engagingly receive a stud from the interconnection structure 18 of an opposing structure element 14.

The several projection members 30 are sequentially depressed and tilted by the user in selected tilt directions D into latching engagement with the shoulder engaging structure 34. Dropping or tossing the composite structure 10 against a triggering object or play surface 40 such as a floor causes one or more projection members 20 to contact the surface 40 and become dislodged from engaging structure 34, so that it or they spring outwardly and drive composite structure 10 in a direction opposite the direction D in which the projection member 30 was tilted during cocking. A moment later composite structure 10 strikes surface 40 again and normally triggers other projection members 30 to release and accelerate composite structure 10 in a new direction.

For spherical balls bouncing on planar surfaces, the angle of ball arrival approximately equals the angle of departure, so that rebound direction is consistent and fully predictable. The cocked projection members 30 of the present composite structure 10, however, drive the composite structure 10 in a direction which may not correspond with the typical rebound angle because the spring 22

What is claimed is:

1. A toy for impacting upon a support surface for entertaining a user by bouncing upon the support surface, comprising:

a composite structure configured to execute a play function, the composite structure including a plurality of removably interconnected structure elements, each said structure element having at least one propulsion mechanism including a spring-loaded, directionally selectable projection member connected to said structure element and oriented to project outwardly from said composite structure for bearing against a support surface.

2. A toy according to claim 1, additionally comprising an element shell, wherein said at least one propulsion mechanism comprises:

one said projection member, a coil spring having a compressed mode and a relaxed mode and having a spring base end and a spring free end, said spring base end being connected to said element shell and said spring free end being connected to said projection member, means for retaining said spring in a compressed mode and angled to a selected direction, and means for releasing said spring from said compressed mode upon impact of said projection member with a triggering object to propel said element shell and said composite structure apart from said triggering object.

3. A toy according to claim 2, wherein said at least one projection member comprises an outwardly extending contact end and an inwardly directed stop end, wherein said means for retaining said spring and said means for releasing said spring comprise a circumferential shoulder between said contact end and said stop end, and wherein said projection member protrudes outwardly from said element shell between opposing and spaced apart said shoulder engaging structure portions, such that pressing said projection member toward said element shell against the biasing of said spring and then tilting said projection member laterally to a certain angle in said selected direction causes said shoulder to move underneath one said shoulder engaging structure portion, and such that subsequently reducing pressing force against said projection member causes said shoulder to move against and into engaging contact with said shoulder engaging structure portion, and such that impact of said projection member with said triggering object dislodges said shoulder from said shoulder engaging structure portion, thereby freeing said projection member to accelerate outwardly with the force of said coil spring against said triggering object.

4. A toy according to claim 3, wherein said projection member is a projection cup member having a substantially circular cup end wall and a tubular cup side wall, and wherein said shoulder is a circumferential jog along said cup side wall, and wherein said spring base end is anchored within a recess in said element shell, wherein said spring is longer in said relaxed mode than said projection cup member and extends into said cup member, wherein said spring free end is connected to said cup end wall, and wherein said shoulder engaging structure comprises a lip protruding radially inwardly around the outer end of said recess.

5. A toy according to claim 4, wherein said recess comprises a recess cup member fitted into a recess receiving port in said element shell and having a circular recess bottom wall and a tubular recess side wall and comprises an outwardly bent shell engaging rim which engages the edge of said recess receiving port.

6. A toy according to claim 4, wherein said triggering object is a play surface and wherein said element shell comprises:

a plurality of said propulsion mechanisms distributed over the outer extremities of said composite structure for depressing and tilting by the user in individually selected directions into engaging with said shoulder engaging structure, such that projecting said composite structure against a play surface causes at least one said projection member to contact said play surface and release said at least one projection member from engagement with its shoulder engaging structure, and such that said at least one projection member springs outwardly and delivers a propulsion member force against said play surface in a direction corresponding to the direction in which said projection member was tilted and said force combines with and alters the existing directional momentum of said composite structure.

7. A toy according to claim 3, wherein said composite structure has at least two of said structure elements, each said structure element having a propulsion mechanism such that a plurality of said propulsion mechanisms are distributed over the outer extremities of said composite structure for depressing and tilting by the user in individually selected directions into engagement with corresponding said shoulder engaging structures, such that projecting said composite structure against said play surface causes at least one of said projection members to contact said play surface and release said at least one projection member from engagement with its shoulder engaging structure, and such that said at least one projection member springs outwardly and delivers a propulsion member force against said play surface in a direction corresponding to the direction in which said projection member was tilted and the force combines with and alters the existing directional momentum of said composite structure.

8. A toy according to claim 1, wherein each said structure element comprises interconnection portion which further comprises interconnection means for joining to the interconnection portion of another said structure element.

9. A toy according to claim 8, wherein said interconnection means comprises:

a connection surface having several connecting studs and several stud receiving recesses which snugly and engagingly receive a stud from the interconnection portion of an opposing said structure element.

10. A toy according to claim 9, wherein said connection surface comprises multiple sides.

11. A toy according to claim 9, wherein said connection surface is curved.

* * * * *